US012604938B2

(12) United States Patent
Glanzer da Conceicao

(10) Patent No.: US 12,604,938 B2
(45) Date of Patent: Apr. 21, 2026

(54) HAIR REPLACEMENT PIECE

(71) Applicant: August Glanzer da Conceicao, Graz (AT)

(72) Inventor: August Glanzer da Conceicao, Graz (AT)

(73) Assignee: AUGUST GLANZER DA CONCEICAO, Graz (AT)

( * ) Notice: Subject to any disclaimer, the term of this patent is extended or adjusted under 35 U.S.C. 154(b) by 395 days.

(21) Appl. No.: 16/972,309

(22) PCT Filed: Jun. 14, 2019

(86) PCT No.: PCT/AT2019/060198
§ 371 (c)(1),
(2) Date: Dec. 4, 2020

(87) PCT Pub. No.: WO2019/241812
PCT Pub. Date: Dec. 26, 2019

(65) Prior Publication Data

US 2021/0227908 A1 Jul. 29, 2021

(30) Foreign Application Priority Data

Jun. 20, 2018 (AT) ..... A50497/2018

(51) Int. Cl.
*A41G 5/00* (2006.01)

(52) U.S. Cl.
CPC ..... *A41G 5/0033* (2013.01); *A41G 5/008* (2013.01)

(58) Field of Classification Search
CPC ..... A41G 5/00; A41G 5/0006; A41G 5/0013; A41G 5/002; A41G 5/006; A41G 5/0033; A41G 3/0008; A41G 3/00016; A41G 3/0016
See application file for complete search history.

(56) References Cited

U.S. PATENT DOCUMENTS 300,938 A * 6/1884 Beck
1,424,845 A * 8/1922 Nolan ..... A41G 3/00 132/53
3,811,453 A * 5/1974 Bretton ..... A41G 5/002 132/53

(Continued)

FOREIGN PATENT DOCUMENTS

DE 28910103 01 8/1998
EP 2803282 A1 11/2014

(Continued)

OTHER PUBLICATIONS

Machine Translation of Jang reference 2003.*

(Continued)

*Primary Examiner* — Rachel R Steitz
(74) *Attorney, Agent, or Firm* — John P. White

(57) ABSTRACT

Hair replacement piece (1) consisting of an essentially oval or polygonal flat structure (2) with embedded replacement hairs comprising in the area of its boundary a localized circumferential thread (3) attachable to one's own hair by hot-melt bonding. In order to enhance the seat and prolong the fastening period of the hair replacement piece at least one additional fastening thread (4) is provided which is connected to the thread (3) with at least on of its two ends (5;6) and runs loosely.

6 Claims, 3 Drawing Sheets

(56) References Cited

U.S. PATENT DOCUMENTS

| | | | | | |
|---|---|---|---|---|---|
| 3,871,389 | A * | 3/1975 | Bauer | A41G 5/002 | 132/53 |
| 4,176,669 | A * | 12/1979 | Levin | A41G 5/0033 | 132/201 |
| 4,254,772 | A * | 3/1981 | McNamee | A41G 5/0013 | 606/187 |
| 4,296,765 | A * | 10/1981 | Bachtell | A41G 5/002 | 132/53 |
| 5,033,486 | A * | 7/1991 | Finamore | A41G 5/0033 | 132/54 |
| 5,979,462 | A | 11/1999 | Jones | | |
| 5,992,424 | A * | 11/1999 | Repsha | A41G 5/0006 | 132/200 |
| 8,186,361 | B2 * | 5/2012 | Hampton | A41G 3/005 | 132/53 |
| 2009/0235948 | A1 | 9/2009 | Zephyr et al. | | |
| 2011/0023902 | A1 * | 2/2011 | Cho | A41G 3/005 | 132/53 |
| 2011/0186065 | A1 * | 8/2011 | Inoue | A41G 5/0006 | 132/54 |
| 2012/0067365 | A1 * | 3/2012 | Brown | A41G 5/002 | 132/201 |
| 2013/0048002 | A1 * | 2/2013 | Alex | A41G 3/0025 | 132/54 |
| 2015/0068546 | A1 * | 3/2015 | Russell | A41G 5/0033 | 132/54 |
| 2017/0208885 | A1 * | 7/2017 | Alex | A41G 5/0093 | |
| 2018/0055122 | A1 * | 3/2018 | Kim | A41G 3/0033 | |
| 2018/0146731 | A1 * | 5/2018 | Toba | A41G 3/0041 | |
| 2018/0177255 | A1 * | 6/2018 | Sandoval | A41G 3/0016 | |
| 2021/0085008 | A1 * | 3/2021 | Thomas | A41G 3/0016 | |
| 2021/0219642 | A1 * | 7/2021 | Rossouw | A41G 3/0033 | |

FOREIGN PATENT DOCUMENTS

| | | | |
|---|---|---|---|
| FR | 625738 | A | 8/1927 |
| KR | 20030007298 | * | 1/2003 |
| TW | I291858 | | 1/2008 |
| WO | WO 2008/148133 | A1 | 12/2008 |

OTHER PUBLICATIONS

Ott, DE 29810103 English Translation, Jan. 1, 2025, Description (Year: 2025).*

Examination Report issued Feb. 14, 2021 in connection with Patent Office of the Cooperation Council for the Arab States of the Gulf Patent Application No. GC 2019-37779.

Search Report for Taiwan Invention Patent Application No. 108120814, completed May 25, 2020.

International Search Report and Written Opinion of the International Searching Authority issued Sep. 6, 2019 in connection with PCT International Application No. PCT/AT2019/060198, including English language translation.

International Search Report issued Sep. 6, 2019 in connection with PCT International Application No. PCT/AT2019/060198.

Written Opinion (form PCT/ISA/237) issued Sep. 6, 2019 in connection with PCT International Application No. PCT/AT2019/060198.

* cited by examiner

HAIR REPLACEMENT PIECE

CROSS-REFERENCE TO RELATED APPLICATIONS

This application is a § 371 national stage of PCT International Application No. PCT/AT2019/060198, filed Jun. 14, 2019, claiming priority of Austrian Patent Application No. A50497/2018, filed Jun. 20, 2018, the contents of each of which are hereby incorporated by reference herein.

BACKGROUND

Technical Field

The invention relates to a hair replacement piece, consisting of an essentially oval or polygonal flat structure with embedded replacement hairs, comprising at the area of its boundary a localized thread attachable to one's own hair by hot-melt bonding.

Related Art

Such hair replacement pieces, usually referred to as a toupee, have been known for a long time. The flat structure is usually a textile net or fabric. The thread located in the area of the boundary mostly runs along the entire circumference, but in some toupees only over a part of it. As a rule, it is a monofilament or multifilament textile thread or a thread mesh that is at least partially coated with a hot melt adhesive.

The toupee is intended to be attached to a person's head over a bald spot (bald head) and attached to the hair surrounding the bald spot by hot-melt bonding. After some time (usually 6-8 weeks), however, an inevitable loosening of the seat of the toupee occurs as a result of the hair regrowth. Depending on the degree of loosening and personal needs, the toupee must then be detached and subsequently re-attached.

SUMMARY

The aim of the invention is to improve the seat and to lengthen the fastening intervals of a toupee.

This aim is achieved according to the invention with a hair replacement piece of the type mentioned at the outset in that at least one additional fastening thread is provided, which is connected to the thread with at least one of its two ends and which runs loosely.

The additional fastening thread, like the thread located in the area of the boundary, is at least partially covered with a hot-melt adhesive. Since it runs loosely-outside and/or inside the flat structure—it can be placed on an additional head/hair section and connected to one's own hairs located there. This ensures additional positional security for the hair replacement piece, as a result of which its readjustment intervals can be extended. The hair replacement piece according to the invention can also have two (or more) additional fastening threads in order to improve the fit of the toupee on the head.

An embodiment of the hair replacement piece according to the invention is preferred in which the fastening thread is connected to the thread with its ends on opposite sides of the flat structure.

By connecting the fastening thread on both sides to the at least partially circumferential thread, a particularly good fastening is achieved in the most common attachment of a toupee on the rear head of a person, since, provided an appropriate toupee arrangement, the fastening thread then extends between the two sides of the head and thus supports the centering of the toupee.

People who want to cover bald spots on their head with a toupee often have outside the bald spot (bald head) already thinning own hair. In order to be able to densify the hair, it is advantageous in accordance with the invention to fix additional replacement hairs on the fastening thread.

The invention is explained below in more detail on basis of exemplary embodiments.

DETAILED DESCRIPTION

Figure 1:
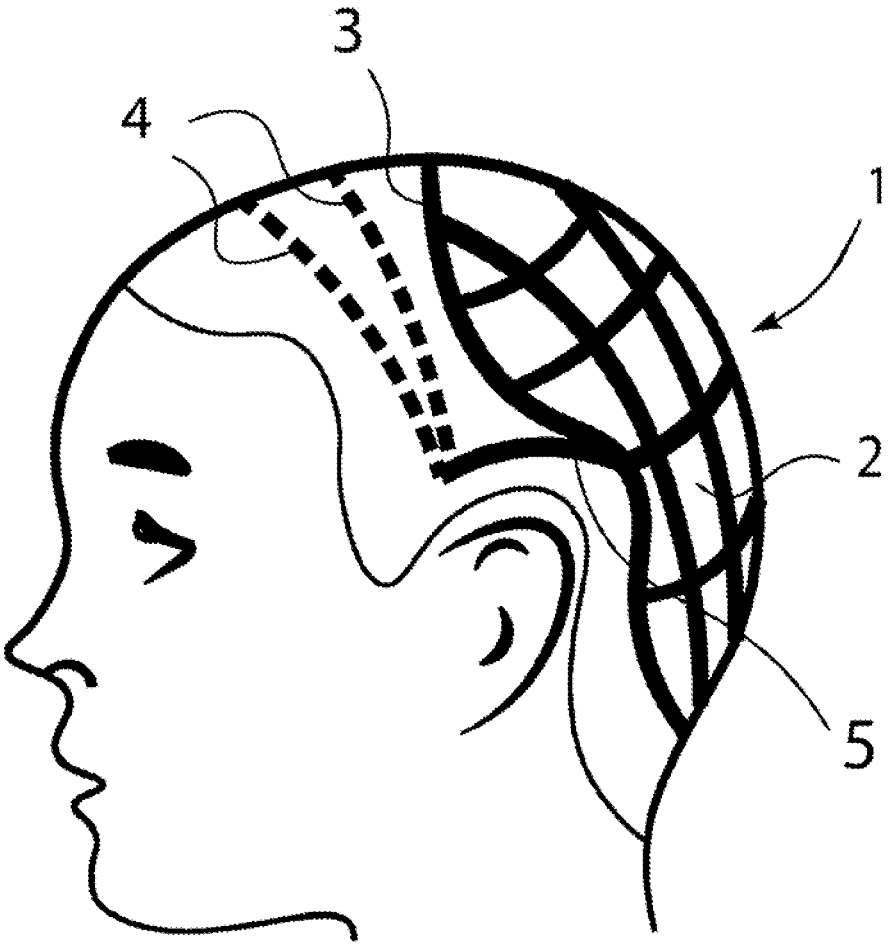
FIG. 1 shows a stylized head of a person with an attached hair replacement piece in a side view.
Figure 2:
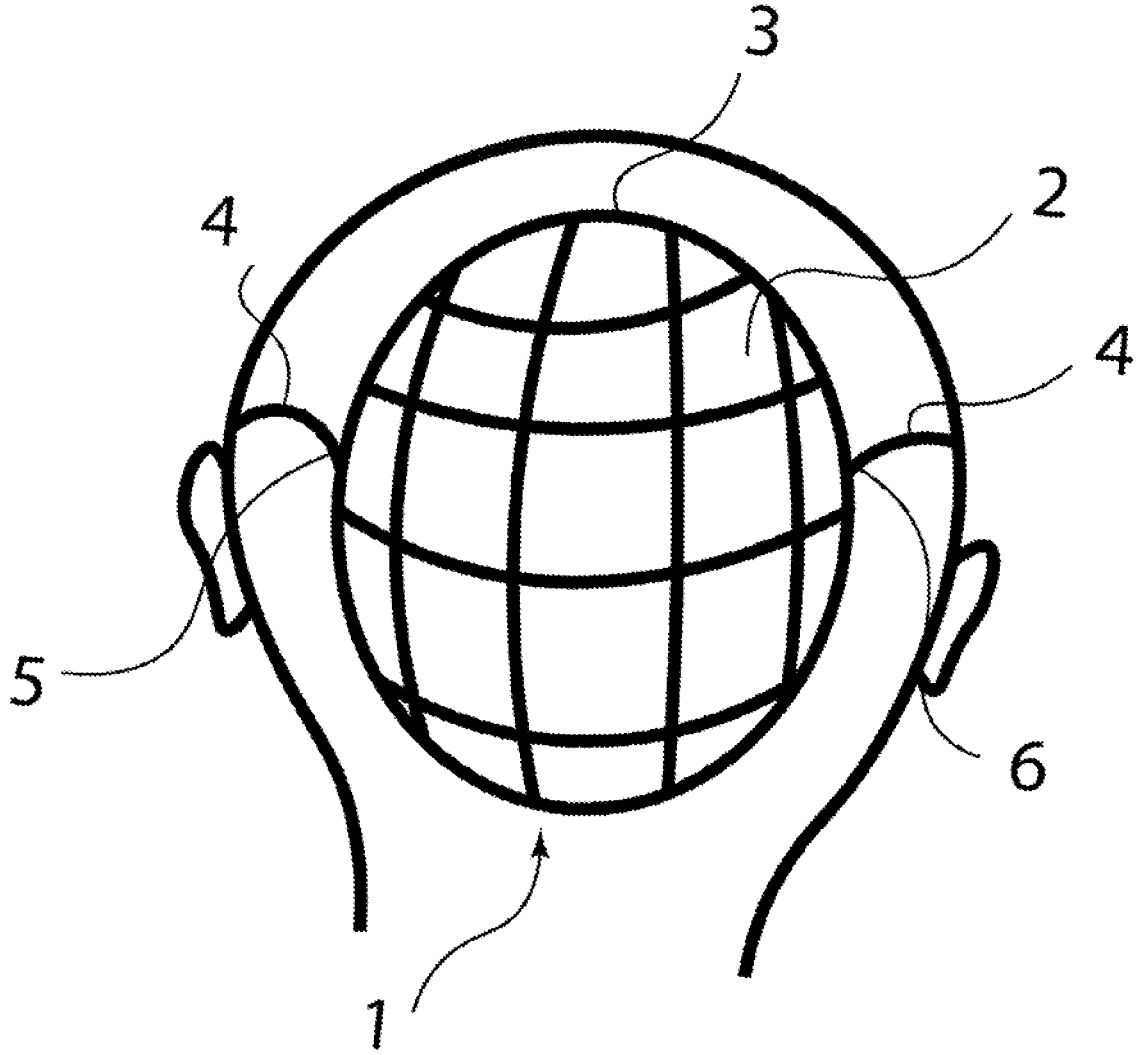
FIG. 2 shows the head from FIG. 1 in a rear view.

According to FIGS. 1 and 2, the hair replacement piece 1 according to the invention consists of an essentially oval flat structure 2—shown here, for example, as a net—with embedded replacement hairs (not shown), which comprises in the area of its boundary a localized, circumferential thread 3 that can be attached to one's own hair by hot-melt bonding. Outside the flat structure 2, at least one further fastening thread 4 (two such threads are indicated by dashed lines in FIG. 1) is provided, which runs loosely and is connected with its ends 5, 6 to the thread 3 on opposite sides of the flat structure 2. Additional replacement hairs (not shown) can be fixed to the fastening thread(s) 4.

Figure 3:
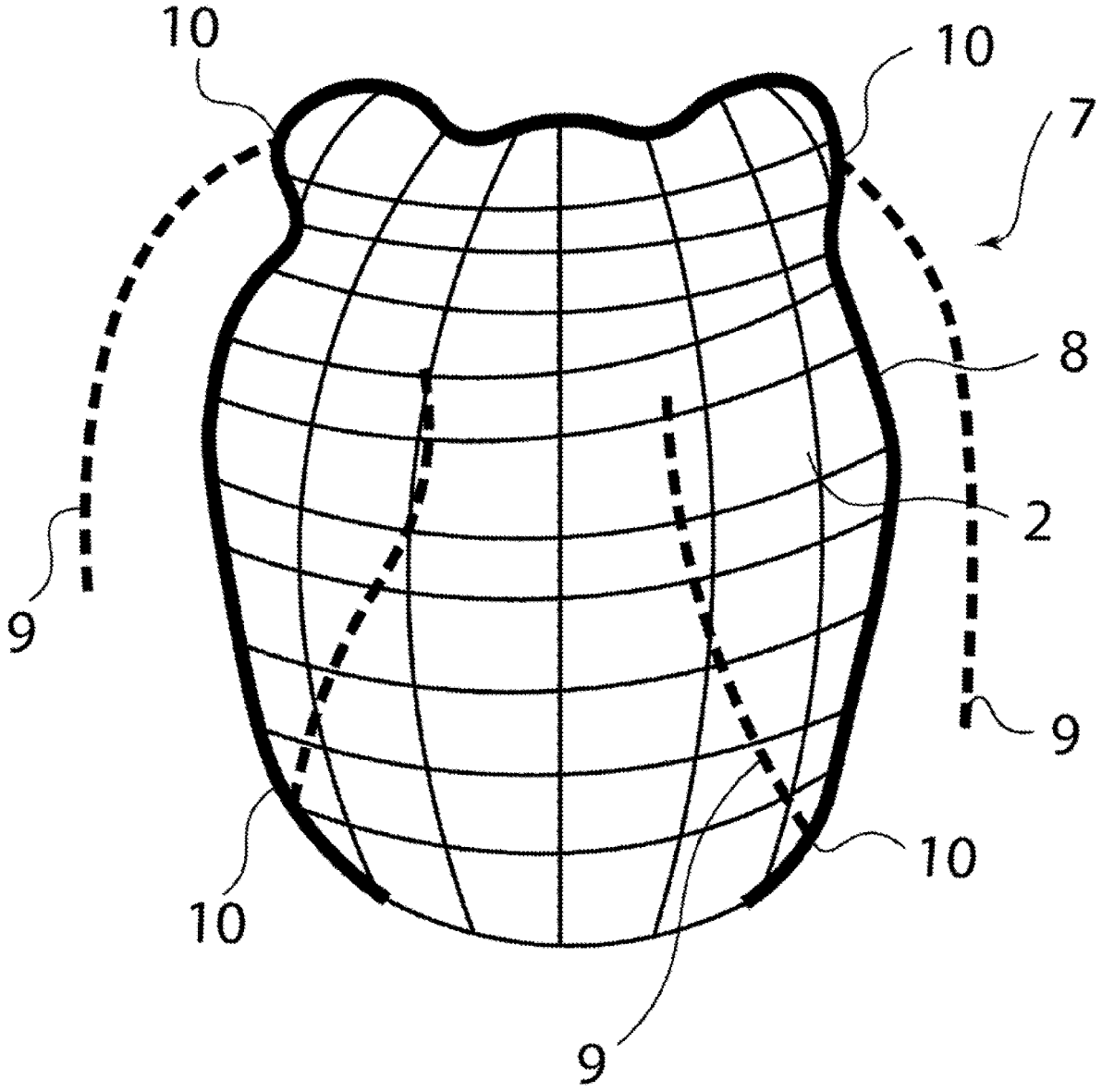
FIG. 3 shows a hair replacement piece with several variants of fastening threads in a plan view.

FIG. 3 illustrates in a single representation several possible design variants of the hair replacement piece according to the invention. In contrast to the hair replacement piece 1, the hair replacement piece 7 does not have an oval, but a polygonal flat structure 2 with embedded replacement hairs (not shown). For example, in the front (forehead) area, "protrusions" are provided on both sides, which (can) serve to cover a receding hairline. The thread 8 localized in the region of the boundary does not extend—in contrast to the circumferential thread 3—over the entire circumference of the flat structure 2. Furthermore, at least one additional, loosely running fastening thread (shown in dashed lines) is provided, which—in contrast to thread 4—is connected to thread 8 by only one of its two ends 10; it can be located inside or outside the flat structure 2. In FIG. 3 two threads 8 running inside and two threads 8 running outside are shown-their number and their course depends on the respective needs (for example the two loose threads 4 shown in FIG. 1 may also extend inside the flat structure 2).

The attachment of the hair replacement piece over a bald spot or a region where one wants to increase the amount of hair on the head takes place in a conventional manner, with the additional fastening thread or the additional fastening threads being tied into the remaining hair outside or inside the area covered by the hair replacement piece. This ensures a better and more sustainable fit of the hair replacement piece.

The invention claimed is:

1. A hair replacement piece configured for attachment to a human subject's head, said hair replacement piece comprising:

an essentially oval or polygonal flat structure with embedded replacement hairs, the flat structure being configured to cover a portion of the human subject's head;

a localized circumferential thread at a boundary of the hair replacement piece corresponding to the portion of the human subject's head; and at least one additional fastening thread with one end of the additional fastening thread connected to the localized circumferential thread at a location corresponding to the portion of the subject head and with the other end of the additional fastening thread running loosely and not being connected to the hair replacement piece, wherein additional replacement hairs are fixed to the at least one additional fastening thread.

2. The hair replacement piece according to claim 1, wherein the at least one additional fastening thread includes multiple additional fastening threads connected with respective one ends to the localized circumferential thread on opposite sides of the flat structure.

3. The hair replacement piece according to claim 1, wherein each of the at least one additional fastening thread is at least partially covered with a hot-melt adhesive.

4. The hair replacement piece according to claim 1, wherein the localized circumferential thread is at least partially covered with a hot-melt adhesive.

5. A hair replacement piece for attachment to a portion of a head of a person and to scalp hair of the person, the hair replacement piece comprising:

an essentially flat structure with embedded replacement hairs configured to cover the portion of the head of the person;

a localized circumferential thread at a boundary of the hair replacement piece and configured and disposed to be fixed to the scalp hair at the portion of the head of the person; and in addition to, and different from, the localized circumferential thread, an additional fastening thread with one end of the additional fastening thread connected to the localized circumferential thread and with the other end of the additional fastening thread running loosely and not being connected to the hair replacement piece, wherein the additional fastening thread is at least partially covered with a hot-melt adhesive.

6. A hair replacement piece for attachment to a portion of a head of a person and to scalp hair of the person, the hair replacement piece comprising:

an essentially flat structure with embedded replacement hairs configured to cover the portion of the head of the person;

a localized circumferential thread at a boundary of the hair replacement piece and configured and disposed to be fixed to the scalp hair at the portion of the head of the person; and in addition to, and different from, the localized circumferential thread, an additional fastening thread with one end of the additional fastening thread connected to the localized circumferential thread and with the other end of the additional fastening thread running loosely and not being connected to the hair replacement piece, wherein the localized circumferential thread is at least partially covered with a hot-melt adhesive.

* * * * *